US005482806A

United States Patent [19]

Suzuki et al.

[11] Patent Number: 5,482,806

[45] Date of Patent: Jan. 9, 1996

[54] DEVELOPER COMPOSITION FOR ELECTROSTATIC LATENT IMAGE COMPRISING TONER AND CARRIER COATED WITH INORGANIC OXIDE PARTICLES

[75] Inventors: Chiaki Suzuki; Tetsu Torigoe; Yoshihiko Iida; Takaichi Kimura; Takayoshi Aoki, all of Kanagawa, Japan

[73] Assignee: Fuji Xerox Co., Ltd., Tokyo, Japan

[21] Appl. No.: 759,435

[22] Filed: Sep. 13, 1991

[30] Foreign Application Priority Data

Sep. 17, 1990 [JP] Japan ..... 2-243775

[51] Int. Cl.[6] ..... G03G 9/083; G03G 9/107

[52] U.S. Cl. ..... 430/106.6; 430/109; 430/110; 430/111; 430/137

[58] Field of Search ..... 430/109, 110, 430/111, 137, 106.6

[56] References Cited

U.S. PATENT DOCUMENTS 4,301,228 11/1981 Kori et al. .
4,678,734 7/1987 Laing et al. ..... 430/137
4,879,198 11/1989 Tavernier et al. ..... 430/106.6
4,920,023 4/1990 Koch et al. ..... 430/126

FOREIGN PATENT DOCUMENTS 60-136775 7/1985 Japan .
61-9661 1/1986 Japan .
63-271471 11/1988 Japan .
63-271473 11/1988 Japan .

OTHER PUBLICATIONS

Crossan, S. C. et al., "Break-in of Toner/Carrier Mix", IBM Tech. Disclosure Bulletin, vol. 23, No. 6, Nov. 1980, pp. 2230–2231.

*Primary Examiner*—S. Rosasco
*Attorney, Agent, or Firm*—Finnegan, Henderson, Farabow, Garrett & Dunner

[57] ABSTRACT

A dry developer composition for an electrostatic latent image is disclosed. The developer composition comprises a magnetic powder-dispersed type carrier comprising a binder resin having dispersed therein a magnetic powder and a toner having adhered thereto inorganic oxide fine particles, wherein at least part of said carrier has previously adhered to the surface thereof inorganic oxide fine particles. The developer composition does not cause background stains over long-term copying even in the relatively initial stage of running.

6 Claims, No Drawings

DEVELOPER COMPOSITION FOR ELECTROSTATIC LATENT IMAGE COMPRISING TONER AND CARRIER COATED WITH INORGANIC OXIDE PARTICLES

FIELD OF THE INVENTION

This invention relates to a two-component developer composition for development of an electrostatic latent image in electrophotography, electrostatic recording, and electrostatic printing, etc.

BACKGROUND OF THE INVENTION

A two-component developer composition comprising a toner and a carrier is frequently used as a developer for developing an electrostatic latent image in electrophotography, etc.

Various carriers for the two-component developer composition are known, typically including electrically conductive carriers, exemplified by iron oxide powder, and coated insulating carriers. The conductive carriers are excellent in solid reproducibility but poor in fine line reproducibility. Besides, toner particles are fused and adhered onto the surface of the carrier, resulting in considerable reduction of chargeability. On the other hand, coated type insulating carriers have poor solid reproducibility, though excellent in durability and fine line reproducibility.

In order to eliminate these disadvantages, a small size carrier comprising a binder resin having dispersed therein magnetic fine particles, so-called a carrier for microtoning, has been proposed and put into practical use. Having a small true specific gravity, high insulating properties, and a small particle diameter, the carrier of this type is known to make a denser and more uniform magnetic brush than by the conventional carriers, and thereby to provide images of improved quality in density reproducibility and freedom from noise, such as brush image.

It is known to use various inorganic or organic fine particles as an external additive for toners in order to improve fluidity, anti-caking properties, fixability, chargeability, cleaning properties, etc. to thereby broaden process suitability of toners. Known additives for such purposes include silica, titanium oxide, aluminum oxide, and tin oxide.

Developer compositions comprising such a toner and the above-mentioned magnetic powder-dispersed type carrier have also been proposed. For example, JP-A-60-136775 (the term "JP-A" as used herein means an "unexamined published Japanese patent application") discloses a developer comprising a magnetic powder-dispersed type carrier and a toner having adhered thereto titaniumoxide/silica fine powder, and JP-A-61-9661 discloses a developer comprising a magnetic powder-dispersed type carrier and a toner having adhered thereto silica fine powder.

On the other hand, a copying machine equipped with an automatic toner concentration controller has recently been adopted, in which a toner is automatically supplied to a developer according to a monitored reduction in image density. However, such a copying machine has turned out to have the following disadvantage when combined with the above-mentioned developer compositions comprising a magnetic powder-dispersed type carrier and a toner having adhered thereto inorganic oxide fine particles. That is, the charge exchanging properties between the toner and the carrier, though satisfactory at the initial stage of copying and after producing 10,000 copies, are deteriorated in the stage intermediate therebetween, i.e., in the relatively initial stage of copying around 5,000 copies, resulting in background stains.

It is assumed that such background stains in the relatively initial stage of running arise for the following reasons. A developer composition containing the magnetic powder-dispersed type carrier has poor fluidity as a whole due to the fact that the carrier has low magnetic properties, it is used as having a relatively small diameter, it has a smaller specific gravity than general carriers, and it is amorphous. Further, since the carrier exhibits strong binding properties to the previously or initially mixed toner particles, the probability of contact between the carrier and a fresh toner which is supplied after the previously or initially mixed toner particles are consumed to some extent is considerably lessened. As a result, the frictional contact between the carrier and the fresh toner is so limited that the charge exchanging properties therebetween is markedly reduced. Therefore, in the copying machine equipped with an automatic toner concentration controller, when the charge quantity of toner particles abnormally increases to cause a reduction in image density, and, accordingly, the developer is automatically replenished with a fresh toner, the charge exchanging properties between the fresh toner and the carrier are so low that frictional electrification among toner particles is accelerated, resulting in production of toner particles of opposite polarity or of insufficient charge quantity which lead to background stains of images.

The fact that no background stain occurs at the initial stage of copying and after copying for a long period of time appears to be accounted for as follows. At the beginning of copying, the charge quantity of the toner is still small, causing no problem. After copying for a long period of time, the inorganic oxide fine powder adhered on the surface of the toner particles is released and transferred to the interface with the carrier to serve as a fluidity aid which increases chances for the carrier and the toner to undergo frictional contact with each other and, at the same time, prevents the toner from overcharging, thereby causing no problem.

The above-described disadvantage associated with a copying machine equipped with an automatic toner concentration controller might be eliminated by adding inorganic oxide fine particles to the toner in excess so as to improve charge exchanging properties in the initial stage of running. However, such a means reduces an absolute charge quantity, eventually leading to considerable impairment of long-term reliability.

SUMMARY OF THE INVENTION

An object of this invention is to provide a two-component developer composition for developing an electrostatic latent image, comprising a magnetic powder-dispersed type carrier which causes no background stains in the relatively initial stage of copying in continuous running.

The present invention relates to a dry developer composition for an electrostatic latent image comprising a magnetic powder-dispersed type carrier comprising a binder resin having dispersed therein a magnetic powder and a toner having adhered thereto inorganic oxide fine particles, wherein at least part of said carrier has previously adhered to the surface thereof inorganic oxide fine particles.

DETAILED DESCRIPTION OF THE INVENTION

The toner in the developer composition for an electrostatic latent image of the present invention mainly comprises a binder resin and a colorant.

Binder resins to be used in the toner include homo- or copolymers of styrene oar derivatives thereof (e.g., styrene and chlorostyrene), monoolefins (e.g., ethylene, propylene, butylene, and isobutylene), vinyl esters (e.g., vinyl acetate, vinyl propionate, vinyl benzoate, and vinyl butyrate), α-methylene aliphatic monocarboxylic acid esters (e.g., methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate), vinyl ethers (e.g., vinyl methyl ether, vinyl ethyl ether, and vinyl butyl ether), and vinyl ketones (e.g., vinyl methyl ketone, vinyl hexyl ketone, and vinyl isopropenyl ketone). Particularly useful binder resins are polystyrene, a styrene-alkyl acrylate copolymer, a styrene-alkyl methacrylate copolymer, a styrene-acrylonitrile copolymer, a styrene-butadiene copolymer, a styrene-maleic anhydride copolymers, polyethylene, and polypropylene. In addition, polyester resins, polyurethane resins, epoxy resins, silicone resins, polyamide resins, modified rosin, paraffin, and waxes can also be used.

Colorants which can be used in the toner typically include carbon black, nigrosine dyes, Aniline Blue, Charcoyl Blue, chrome yellow, ultramarine blue, Du Pont Oil Red, Quinoline Yellow, Methylene Blue chloride, Phthalocyanine Blue, Malachite Green oxalate, lamp black, Rose Bengale, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and C.I. Pigment Blue 15:3.

If desired, the toner may further contain a charge control agent (e.g., positive charge control agents such as nigrosine dye, quaternary ammonium salts, pyridinium salts, and phosphoniumsalts, negative charge control agents such as metal complex salts of monoazo dyes, copper phthalocyanine derivatives, and tetraphenylboron derivatives, etc.), a cleaning aid (e.g., vinylidene polyfluoride resin, fluorine-containing resins such as polytetrafluoroethylene, (meth-)acrylic acid alkylester resins such as polymethyl methacrylate, metal salts of long-chain saturated or unsaturated fatty acids, etc.), a fluidity accelerator, and so on.

The toner may be either a magnetic toner containing therein a magnetic substance or a capsule toner.

The toner particles usually have an average particle size of about 30 μm or less, and preferably from 3 to 20 μm.

The inorganic oxide fine particles which can be adhered to the surface of toner particles include fine particles of $SiO_2$, $CeO_2$, $BASO_4$, $TiO_2$, $SnO_2$, $Al_2O_3$, $Fe_2O_3$, MnO, ZnO, MgO, CaO, $K_2O$, $Na_2O$, $ZrO_2$, CaO.SiO, $K_2O.(TiO_2)_n$, and $Al_2O_3.2SiO_2$. Particles having a volume resistivity of from $10^5$ to $10^{12}$ Ω.cm are preferred.

The inorganic oxide fine particles have an average particle size of preferably from 5 to 1,000 nm (1 μm), and more preferably from 5 to 100 nm (0.1 μm).

These inorganic oxide fine particles may be subjected to surface treatment with organic substances as an agent imparting hydrophobic properties. Specific examples of the agent imparting hydrophobic properties include silane coupling agents (e.g., chlorosilanes such as methyltrichlorosilane, methyldichlorosilane, dimethyldichlorosilane, trimethylchlorosilane, phenyltrichlorosilane, and diphenyldichlorosilane, alkoxysilanes such as tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, and decyltrimethoxysilane, silazanes such as hexamethyldisilazane, etc.); silane coupling agents a part of which is substituted with fluorine; special modified silicone oil (in which silane coupling agents having a double bond is subjected to a special treatment); titanate coupling agents (e.g., isopropyltriisostearoyl titanate, isopropyltridecylbenzenesulfonyl titanate, isopropyltris(dioctylpyrophosphate) titanate, tetraisopropylbis(dioctylphosphate) titanate, tetraoctylbis(ditridecylphosphate) titanate, tetra(2,2-diallyloxymethyl-1-butyl)bis(didodecyl)phosphate titanate, etc.); long-chain organic acids (e.g., saturated fatty acids such as lauric acid, tridecanoic acid, myristic acid, pentadecanoic acid, palmitic acid, margaric acid, stearic acid, nonadecanoic acid, and montanic acid, normal acetylene fatty acids such as stearolic acid and behenolic acid, ω-phenyl fatty acids represented by $C_6H_5(CH_2)_nCOOH$, ω-cyclohexyl fatty acids represented by $C_6H_{11}(CH_2)_nCOOH$, etc.); and alcohols (e.g., trimethylolpropane, pentadecanol, cetylalcohol, heptadecanol, octadecanol, nonadecanol, eicosanol, etc.).

Further, the inorganic oxide fine particles may be used in combination with other inorganic or organic fine particles, e.g., polymethyl methacrylate fine particles.

Adhesion of the inorganic oxide fine particles to the toner surface can be carried out by mixing toner particles with the inorganic oxide fine particles in, e.g., a Henschel mixer. The amount of the inorganic oxide fine particles to be added preferably ranges from 0.1 to 5.0% by weight based on the total toner weight. If it is less than 0.1% by weight, the effects of addition tend to be insufficient. If it exceeds 5.0% by weight, the absolute charge quantity tends to be reduced.

The carrier according to the present invention is a magnetic powder-dispersed type carrier mainly comprising a binder resin and a magnetic powder. Any of the binder resins enumerated above for the toner can also be used in the carrier.

Magnetic powders which can be used in the carrier may be any of commonly employed ferromagnetic fine particles. Examples of suitable magnetic fine particles include tri-iron tetroxide, α-iron sesquioxide, various ferrite powders, chromium oxide, and various metallic fine powders.

The magnetic powder content in the carrier ranges usually from about 30 to 95%, and preferably from 45 to 90%, by weight based on the total weight of the carrier.

If desired, the carrier may further contain a charge control agent, etc.

The carrier can be prepared by kneading and grinding the above components, and classification. Alternatively, the above components are dissolved in an appropriate solvent or liquefied by heating, followed by solidification by, for example spray drying.

The carrier particles usually have an average particle size of from about 20 to 400 μm, and preferably from 30 to 100 μm.

In the present invention, it is essential that inorganic oxide fine particles should be adhered to the surface of at least part of the above-described carrier prior to mixing with the toner. Any of the inorganic oxide fine particles enumerated above for adhesion to toner particles may also be used here. It is preferable that the inorganic oxide fine particles to be adhered to the carrier should be the same as that to be adhered to the toner.

In the developer of the present invention, the content of the previously surface-treated carrier is preferably at least 3 wt % based on the total carrier weight. If the previously surface-treated carrier is less than 3 wt %, the inorganic oxide fine particles are isolated, and as a result they are adhered to the toner or are scattered from the developer. When the isolated inorganic oxide particles are adhered to the toner, charge quantity of the toner tends to be reduced. On the other hand, when they are scattered from the developer, dirt, blank area in the solid image, etc., are liable to occur.

The amount of the inorganic oxide fine particles adhered to the carrier surface preferably ranges from 0.03 to 1.0% by weight based on the total carrier weight. If it is less than 0.03% by weight, charge exchanging properties tend to be insufficient. If it exceeds 1.0% by weight, although charge exchanging properties are markedly improved, the absolute charge quantity tends to be reduced, making it difficult to obtain halftone of a solid image.

Adhesion of the inorganic oxide fine particles to the surface of carrier particles can be carried out by mechanical mixing of the carrier particles and the inorganic oxide fine particles. Mixing is desirably performed under mild conditions by, for example, using a twin-cylinder mixer, so that the inorganic oxide fine particles may be loosely adhered to the surface of the carrier particles and easily released therefrom. Preferably, adhesion of the inorganic oxide fine particles to the surface of carrier particles is carried out so that the strength of adhesion expressed in terms of A/B ratio described hereinafter is from 0.5 to 0.95.

The thus prepared toner and carrier are mixed at an appropriate ratio to prepare a two-component developer composition.

Where a carrier having thereon no inorganic oxide fine particles is used, charges are accumulated during the relatively initial stage of running because of high insulating properties of the carrier to show high charging properties. To the contrary, since the carrier particles of the present invention have adhered thereon inorganic oxide fine particles, the carrier surface has increased conductivity so that the accumulation of charges is suppressed thereby to prevent the carrier from highly charged and, at the same time, to control charge exchange, making it possible to smoothly perform charge exchanging between the carrier and the fresh toner which is supplied according to toner consumption in the relatively initial stage of copy running.

The present invention is now illustrated in greater detail with reference to Examples, but it should be understood that the present invention is not deemed to be limited thereto. All the parts, percents and ratios are by weight unless otherwise indicated.

EXAMPLE 1

Toner:

| | |
|---|---|
| Styrene-butyl acrylate copolymer (80/20) | 100 parts |
| Carbon black ("REGAL 330" produced by Cabot) | 10 parts |
| Low-molecular-weight polypropylene ("VISCOL 660p" produced by Sanyo Kasei K.K.) | 5 parts |
| Charge control agent ("BONTRON P-51" produced by Orient Kagaku K.K.) | 1 part |

The above components were melt-kneaded in a Banbury mixer, cooled, and pulverized in a jet mill. The particles were classified by means of a classifier to obtain toner particles having an average particle diameter $d_{50}$ of 11 μm.

To 100 parts of the resulting toner particles was added 1.5 parts of $TiO_2$ fine particles having an average volume diameter of 0.1 μm (volume resistivity: $2.0\times10^7$ Ω.cm), and the mixture was dispersed in a Henschel mixer to prepare a toner having adhered thereto $TiO_2$ fine particles.

Magnetic Carrier:

| | |
|---|---|
| Magnetite ("EPT 1000" produced by Toda Kogyo K.K.) | 100 parts |
| Styrene-butyl acrylate copolymer (80/20) | 30 parts |

The above components were melt-kneaded in a pressure kneader, pulverized in a turbo-mill, and classified by means of a classifier to obtain an untreated carrier having an average volume diameter $d_{50}$ of 50 μm.

A hundred parts of the resulting carrier were mixed and dispersed with 0.2 part of $TiO_2$ fine particles having an average volume diameter of 0.1 μm (volume resistivity: $2.0\times10^7$ Ω.cm) in a twin-cylinder mixer to obtain a carrier having adhered thereto $TiO_2$ fine particles.

A hundred parts of the treated carrier and 5 parts of the above-prepared toner were mixed in a twin-cylinder mixer to prepare a dry developer.

EXAMPLE 2

A dry developer was prepared in the same manner as in Example 1, except for replacing the $TiO_2$ fine particles to be adhered to the toner particles and the carrier with equivalent amounts of $Al_2O_3$ fine particles having an average particle diameter of 0.05 μm (volume resistivity: $4.0\times10^{10}$ Ω.cm).

EXAMPLE 3

A dry developer was prepared in the same manner as in Example 1, except for replacing the $TiO_2$ fine particles to be adhered to the toner particles and the carrier with equivalent amounts of $SnO_2$ fine particles having an average particle diameter of 0.2 μm (volume resistivity: $3.5\times10^9$ Ω.cm).

EXAMPLE 4

A dry developer was prepared in the same manner as in Example 1, except for replacing the $TiO_2$ fine particles to be adhered to the carrier with equivalent amounts of $Al_2O_3$ fine particles having an average particle diameter of 0.05 μm (volume resistivity: $4.0\times10^{10}$ Ω.cm).

EXAMPLE 5

A dry developer was prepared in the same manner as in Example 1, except for changing the amount of the $TiO_2$ fine particles to be adhered to the carrier to 0.03 part.

EXAMPLE 6

A dry developer was prepared in the same manner as in Example 1, except for changing the amount of the $TiO_2$ fine particles to be adhered to the carrier to 1.0 part.

EXAMPLE 7

Toner particles having adhered thereto $TiO_2$ fine particles were prepared in the same manner as in Example 1.

An untreated carrier was prepared in the same manner as in Example 1, and 100 parts of the resulting carrier was mixed and dispersed with 2 parts of $TiO_2$ fine particles having a particle diameter of 0.1 μm in a Henschel mixer.

Ten parts of the thus treated carrier, 100 parts of the untreated carrier, and 5 parts of the toner were mixed in a twin-cylinder mixer to prepare a dry developer.

COMPARATIVE EXAMPLE 1

A dry developer was prepared in the same manner as in Example 1, except for using the untreated carrier in place of the carrier having adhered thereto $TiO_2$ fine particles.

COMPARATIVE EXAMPLE 2

Toner particles having an average particle diameter of 11 μm were prepared in the same manner as in Example 1. A hundred parts of the resulting toner particles were mixed and dispersed with 6 parts of $TiO_2$ fine particles having an average volume diameter of 0.1 μm in a Henschel mixer to prepare a toner.

A hundred parts of the untreated carrier prepared in Example 1 and 5 parts of the toner were mixed in a twin-cylinder mixer to prepare a dry developer.

Continuous copying test was carried out using each of the dry developers obtained in Examples 1 to 7 and Comparative Examples 1 and 2 and an electrophotographic copying machine ("FX-5075" manufactured by Fuji Xerox Co.). Performance properties of the developer were evaluated as follows, and the results obtained are shown in Table 1 below.

1) Toner Concentration (TC):

The developer immediately after the preparation and at the time of obtaining 5,000 copies was washed to remove the toner, and the toner concentration (TC), i.e., a weight proportion of the toner in the developer, was calculated from the weight change.

2) Charge Quantity

Measurements of charge quantity were made by means of "TB 200" manufactured by Toshiba K.K. at the same stage of measurement of TC.

3) TC Latitude:

TC latitude was determined at the time of obtaining the 5,000th copy. TC latitude is a value obtained by subtracting a minimum TC (the TC at which a Macbeth value of 1.0 GSAD is at least 1.2, wherein "1.0 GSAD (Gray Solid Area Density)" means a copy density using an original of 1.0 gray solid) from a maximum TC (the upper limit of TC at which fog occurred). Therefore, TC latitude 0 means that there is no such a concentration range that satisfies a predetermined solid developed density without causing fog.

4) Durability:

Durability of the developer was expressed in terms of number of copies obtained without suffering from fog.

5) Adhesion of Inorganic Oxide Fine Particles:

The treated carrier was rinsed with an aqueous solution containing a surface active agent to remove released inorganic oxide fine particles (including those particles which had been adhered so weakly as to be removed through rinsing). The rinsed carrier was molded into a disk, and the amount of remaining inorganic oxide (A) was determined by X-ray fluorometry. As a standard, the inorganic oxide amount adhered to the non-rinsed carrier (B) was measured by X-ray fluorometry. The strength of adhesion was expressed in terms of A/B ratio.

TABLE 1

| | Immediately After Preparation | | At the Time of Obtaining 5,000 Copies | | | | Adhesion Strength |
|---|---|---|---|---|---|---|---|
| Example No. | TC (%) | Charge Quantity (μC/g) | TC (%) | Charge Quantity (μC/g) | TC Latitude (%) | Developer Durability | of Inorganic Oxide Fine Particles (A/B) |
| Example 1 | 4.8 | 16 | 4.2 | 18 | 15 | ≧ 100,000 copies | 0.52 |
| Example 2 | 4.8 | 20 | 4.8 | 16 | 12 | ≧ 100,000 copies | 0.75 |
| Example 3 | 4.8 | 14 | 3.5 | 12 | 10 | ≧ 100,000 copies | 0.40 |
| Example 4 | 4.8 | 12 | 5.4 | 16 | 8 | ≧ 100,000 copies | 0.75 |
| Example 5 | 4.8 | 18 | 6.0 | 16 | 4 | ≧ 100,000 copies | 0.50 |
| Example 6 | 4.8 | 10 | 3.5 | 8 | 4 | ≧ 100,000 copies | 0.55 |
| Example 7 | 4.8 | 16 | 3.5 | 18 | 10 | ≧ 100,000 copies | 0.95 |
| Comparative Example 1 | 4.8 | 18 | 12.4 | 16 | 0 | Fog occurred in the initial stage but not after the 20,000th copy. | — |
| Comparative Example 2 | 4.8 | 4 | 1.8 | 2 | 0 | Fog occurred in the 1,000th copy and ever afterward. | — |

Having the above-mentioned construction, the developer composition according to the present invention, when used in continuous running of copying, always shows satisfactory charge exchanging properties between toner and carrier particles without causing background stains over a long period of time from the very beginning of running through the stage after obtaining 100,000 copies. That is, the present invention settles down the problem of background stains in the relatively initial stage of copying of about 5,000 copies which has accompanied the use of a copying machine equipped with an automatic toner concentration controller, thereby making it possible to obtain copies of satisfactory image quality for an extended period of time from the initial stage and ever afterward.

While the invention has been described in detail and with reference to specific embodiments thereof, it will be apparent to one skilled in the art that various changes and modifications can be made therein without departing from the spirit and scope thereof.

What is claimed is:

1. A dry developer composition for an electrostatic latent image comprising a mixture of a magnetic powder-dispersed carrier comprising a binder resin having dispersed therein a magnetic powder and a toner having adhered thereto inorganic oxide fine particles, wherein prior to mixing said carrier with said toner at least part of said carrier has adhered to the surface thereof inorganic oxide fine particles.

2. A dry developer composition as claimed in claim 1, wherein the amount of the inorganic oxide fine particles adhered to the toner is from 0.1 to 5.0% by weight based on the total weight of the toner, and the amount of the inorganic oxide fine particles adhered to the carrier is from 0.03 to 1.0% by weight based on the total weight of the carrier.

3. A dry developer composition as claimed in claim 1, wherein the inorganic oxide fine particles adhered to the toner and those adhered to the carrier are the same.

4. A dry developer composition as claimed in claim 1, wherein the inorganic oxide fine particles adhered to the toner and those adhered to the carrier are selected from the group consisting of fine particles of $SiO_2$, $CeO_2$, $BaSO_4$, $TiO_2$, $SnO_2$, $Al_2O_3$, $Fe_2O_3$, MnO, ZnO, MgO, CaO, $K_2O$, $Na_2O$, $ZrO_2$, CaO.SiO, $K_2O.(TiO_2)_n$, and $Al_2O_3$. $2SiO_2$.

5. A dry developer composition as claimed in claim 1, wherein the inorganic oxide fine particles have an average particle size of from 5 to 1,000 nm.

6. A dry developer composition as claimed in claim 1, wherein the inorganic oxide fine particles have an average particle size of from 5 to 100 nm.

* * * * *